US006354353B1

(12) United States Patent
Green et al.

(10) Patent No.: US 6,354,353 B1
(45) Date of Patent: Mar. 12, 2002

(54) DOOR AND WINDOW COVERINGS EMPLOYING LONGITUDINALLY RIGID VANES

(75) Inventors: Jace N. Green, West Jordan; Bryan K. Ruggles, Salt Lake City, both of UT (US); Roger Palmer, Greensboro, NC (US)

(73) Assignee: Newell Window Furnishings, Inc., Freeport, IL (US)

( * ) Notice: Subject to any disclaimer, the term of this patent is extended or adjusted under 35 U.S.C. 154(b) by 0 days.

(21) Appl. No.: 09/593,911

(22) Filed: Jun. 14, 2000

(51) Int. Cl.[7] ..... E06B 9/06
(52) U.S. Cl. ..... 160/84.04; 160/89
(58) Field of Search ..... 160/84.01, 84.04, 160/84.05, 84.06, 236, 170 R, 89, 173 R, 173 V, 176.1 R, 176.1 V, 168.1 R, 168.1 V

(56) References Cited

U.S. PATENT DOCUMENTS

| | | | | |
|---|---|---|---|---|
| 1,937,342 A | * | 11/1933 | Higbie | 160/84.05 X |
| 2,121,217 A | | 6/1938 | Ellis | 156/17 |
| 2,123,010 A | | 7/1938 | Kahn | 156/17 |
| 2,326,454 A | | 8/1943 | Gentile | |
| 2,590,204 A | | 3/1952 | Phillips | 160/236 |
| 2,855,039 A | | 10/1958 | Gross | |
| 3,472,305 A | | 10/1969 | Lefes | 160/236 |
| 4,154,889 A | | 5/1979 | Platt | 428/234 |
| 4,309,472 A | | 1/1982 | Götting et al. | 428/224 |
| 4,352,384 A | * | 10/1982 | McCoy | 160/236 X |
| 4,490,425 A | | 12/1984 | Knoke et al. | 428/90 |
| 4,519,435 A | | 5/1985 | Stier | 160/166 A |
| 4,818,590 A | * | 4/1989 | Prince et al. | 160/236 X |
| 5,049,424 A | | 9/1991 | Carden et al. | |
| 5,101,876 A | | 4/1992 | Zak | 160/236 |
| 5,141,042 A | | 8/1992 | Schwaegerle | 160/236 |
| 5,163,951 A | | 11/1992 | Pinchuk et al. | |
| 5,273,781 A | | 12/1993 | Shu | 427/176 |
| 5,297,607 A | | 3/1994 | Beauchamp | |
| 5,303,507 A | | 4/1994 | Oille | |
| 5,355,928 A | * | 10/1994 | Robertson | 160/84.04 |
| 5,466,516 A | | 11/1995 | Lutzow et al. | 428/282 |
| 5,482,100 A | | 1/1996 | Kuhar | 160/170 |
| 5,531,257 A | | 7/1996 | Kuhar | 160/168.1 |
| 5,593,768 A | | 1/1997 | Gessner | 428/286 |
| 5,601,132 A | | 2/1997 | Goodman | 160/236 |
| 5,603,369 A | | 2/1997 | Colson et al. | |
| 5,749,404 A | * | 5/1998 | Colson | 160/84.04 |
| 5,797,442 A | | 8/1998 | Colson et al. | 160/236 |
| 5,845,690 A | * | 12/1998 | Colson et al. | 160/84.01 |
| 5,897,731 A | | 4/1999 | Colson et al. | 156/197 |
| 5,960,850 A | | 10/1999 | Colson et al. | 160/236 |
| 6,153,283 A | | 11/2000 | Pierson et al. | |

FOREIGN PATENT DOCUMENTS

| | | | |
|---|---|---|---|
| EP | 0 692 602 A1 | 1/1996 | E06B/9/262 |
| WO | WO 96/35881 | 11/1996 | F06B/9/386 |

* cited by examiner

*Primary Examiner*—David M. Purol
(74) *Attorney, Agent, or Firm*—Foley & Lardner

(57) ABSTRACT

A covering for window or doors includes a plurality of vanes mounted horizontally or vertically, the vanes being light in weight and longitudinally rigid. The vanes may be foam filled or may include a vane shell made from a polymer matrix, and in either case may optionally include a decorative fabric covering. In the hollow vane embodiment, the vane shell preferably includes a polymer matrix at least partially enveloping fibers, and in the most preferred embodiment is prepared from a fibrous batt including two different thermoplastic resin fibers, one having a lower melting point than the other. The vane shell is formed by thermally treating the batt to at least partially melt the lower melt fibers to at least partially envelope the higher melt fibers. Alternative embodiments of the invention described herein include the horizontal or vertical mounting of the foam core or hollow vanes, the attachment of sheer fabrics thereto, the use of ribbon or cord tilt control systems for the vanes, and other features which create door or window coverings providing light control, insulation, stacking to the side or top, and the capability for cordless operation when the vanes are used in a horizontal orientation.

21 Claims, 7 Drawing Sheets

DOOR AND WINDOW COVERINGS EMPLOYING LONGITUDINALLY RIGID VANES

CROSS-REFERENCE TO RELATED APPLICATIONS

None

BACKGROUND OF THE INVENTION

1. Field of the Invention

The present invention relates generally to the art of coverings for doors and windows, and more particularly it relates to the use of lightweight, longitudinally rigid, three dimensional vanes in either horizontal or vertical systems, and with or without a sheer fabric being attached to the vanes to create a variety of new door and window coverings. In its most preferred embodiments, the vanes have a generally air foil shape, have their thin or rearward edges attached to a sheer fabric, and have a tilt control mechanisms to move the vanes between overlapping and generally parallel orientations.

2. Description of the Prior Art

A wide variety of blinds, shades, curtains and other types of coverings for doors and windows are known to the art. These include very old product categories, such as roller shades and venetian-type blinds, as well as the newer types of "soft" window coverings, including pleated or cellular blinds and shades, various light control products, Roman shades and fabric covered vertical blinds. The latter typically include a track which extends across an opening to be covered, with trucks mounted to the track for movement by a wand device or by cords and pulleys. Vanes are attached to the truck and are pivotable about a vertical longitudinal axis to open them to a first position which permits light to enter a room and to a second position in which the vanes overlap one another, in which case privacy is achieved. Moreover, lightweight fabric sheets have been proposed for attachment to thin, rigid vanes in vertical systems to achieve a different look. See U.S. Pat. No. 5,638,881 issued to Ruggles, et al. on Jun. 17, 1997 and entitled "Blind With Curtain", which patent is assigned to the assignee of the present invention.

Recently, a number of different vertical blind products have been proposed which include hollow fabric vanes. These can include stiffening compounds to ensure that the bottom rotates the same amount as the top. It has also been proposed that these vanes be prepared in a tubular configuration, the cross-section of which simulates an air foil. These known vanes are made from a fabric material having diagonal, dimensional stability or memory so that they resist stretching in a longitudinal direction. It is also known that with such vanes, a reinforcing strip can be applied about an open end of the vane to provide a durable attachment location for supporting the vane from the truck of the operating system. Patents describing such vanes include U.S. Pat. No. 5,797,442 issued Aug. 25, 1998 to Colson, et al. for "Vanes For Architectural Covering And Method Of Making Same" and U.S. Pat. No. 5,960,850 issued on Oct. 5, 1999 to Colson, et al. for "Vane For An Architectural Covering".

Preferred vanes used in the aforementioned Colson, et al. patent have a cross-sectional configuration best illustrated in FIG. 6B of the '442 patent, i.e. one resembling an air foil. Various techniques are described for ensuring that the shape is maintained, such as the use of the aforementioned stiffening compounds, or in the embodiment shown in FIG. 12, the use of a relatively narrow resilient rubber strip along the inside of the blunt or forward end of the vane. Various single and double thickness vanes, and further vane structures, are also disclosed in PCT International Application No. WO96/35881 filed by the same inventors, which application claims priority to the parent application of the aforementioned '442 Colson, et al. patent.

FIG. 1 of the Colson, et al. '442 patent discloses a vertical arrangement in which a plurality of vanes are suspended from a track 30 and are pulled across the opening to be covered using a wand. The vanes may be rotated to an open, light admitting position as shown in FIG. 1, or to a privacy position as shown in FIG. 3. If the vane is constructed from transparent or sheer materials, light can be admitted in a diffused pattern into the room when the vanes are in a closed position, as illustrated in FIG. 4 of this patent. An important characteristic of this patent series, however, is that the materials used for the vanes be flexible, even in embodiments which are described as "laminate" structures, where a functional interior layer is applied to a decorative exterior layer. There is no teaching or suggestion in the Colson, et al. patent series of using air foil vanes in horizontal systems, as the flexible nature of the vanes would cause the vanes to sag and destroy the aesthetics.

Roman shade products can also be prepared in a variety of different ways, one of which is illustrated in U.S. Pat. No. 5,897,731 issued on Apr. 27, 1999 to Wendell B. Colson, et al. and entitled "Method And Apparatus For Manufacturing A Looped Cellular Shade". In this patent, three dimensional cellular shades which have the general appearance of a Roman shade are prepared using two sheets of fabric, one of which is looped as it is attached to the other. The joints between the two sheets are uniformly displaced from one another and the ratio of the looped decorative fabric to the functional non-looped fabric is greater than one. The ratio is important to ensure that the cells will expand outward as the shade is unrolled. In the embodiment shown and described in connection with FIG. 11, a strip of laminate may be applied to the outside of each of the loops, but such laminating strips do not alter the flexible nature of the loops as is indicated in that FIGURE.

The assignee of the present invention has already filed an application for a "Foam Core Vane For Door And Window Coverings", i.e. on Aug. 10, 1999 in the name of Bryan K. Ruggles, which application has been granted Ser. No. 09/371,226. In this application, hollow vanes are filled in situ with foam forming materials, such as urethane and polyisocyanurate foams, to cause the vanes to be rigid and allowing them to be used in door and window coverings. The polymeric foam forming liquid is placed inside a fabric sleeve in a mold, so that the sleeve fills when the foam expands to the desired end use shape, most preferably an air foil, cross-sectional shape. This patent application also describes the use of such foam core vanes in horizontal systems. In connection with the horizontal systems, the application indicates that sheer fabric strips may be attached thereto, and an example indicates that such vanes can be manipulated in the ways typically practiced for venetian or mini-blind products in which lift cords are used for altering the distance between the bottom rail and head rail and tilting the vanes for light control.

Different types of window slats and vanes are described in a pair of additional applications filed on the same date as this application, one being entitled "Window Covering Slat" and assigned Ser. No. 09/593,843 and the other entitled "Hollow, Rigid Vanes For Door And Window Coverings" and assigned Ser. No. 09/594,619. These applications resemble one another to the extent that they each use a slat base or vane shell which includes a polymer matrix and a plurality of fibers at least partially enveloped by the polymer matrix. In the "Window Covering Slat" application, a fabric covering is preferably attached to the slat base and the slat base with covering may be formed in a variety of cross-sectional shapes including a gently rounded shape (as is typically employed in mini-blind products), S-shaped slats, etc. In the other application, hollow, rigid vanes are constructed from a vane shell or a vane shell which has a fabric covering attached thereto. The two applications share a feature, i.e. the use of a material for the slat base or vane shell which includes fibers disposed in a polymer matrix. In the preferred embodiments described in the two applications, the base or shell is prepared from a fibrous batt comprising two types of fibers, at least one of which is a thermoplastic resin and has a melting point less than the other fiber type. Upon heating the low-melt fiber to the melting point, the low-melt fiber at least partially melts to create a polymer matrix which at least partially envelopes the higher melting fibrous material. At this stage, the combination can be formed into any desired shape, such as an air foil shape or a curled edge shape, and following cooling, the polymer matrix becomes rigid. In the application relating to slats, the slats may be used in horizontal or vertical blinds of the type generally described above, and in the hollow, rigid vane application, the vanes may be used in vertical or horizontal applications including those involving the attachment of sheer fabric strips or sheets thereto.

While the various prior art references described in this section provide useful coverings for doors and windows, a number of additional types of coverings for doors and windows can be employed using rigid, decorative vanes of either the hollow or foam core variety. Such new types of window coverings would represent significant advances in this art.

FEATURES AND SUMMARY OF THE INVENTION

A feature of the present invention is to provide new types of coverings for doors and windows which employ longitudinally rigid vanes.

Another feature of the invention is to provide Roman shade appearing door and window coverings using lightweight, rigid vanes.

A different feature of the present invention is to provide window coverings utilizing three dimensional, rigid vanes which enhance the insulation capabilities of the door or window covering.

Another feature of the present invention is to provide window coverings using these lightweight, longitudinally rigid vanes having light control (i.e. room darkening, privacy and clear view capabilities), depending upon vane location and further components used with the vanes.

A still further feature of the present invention is to provide a covering for doors or windows which may be used in a cordless operating system due to the lightweight nature of the vane.

Another feature of the invention is to provide coverings for doors or windows which, whether in a horizontal or a vertical orientation, allow the vanes to stack to a side (in a vertical orientation) or at the top (in a horizontal orientation).

Yet another different feature of the present invention is to provide coverings for doors and windows which utilize three dimensional, longitudinally rigid vanes which are soft to the touch and for which various surface treatments may be applied, such as water or stain repellants and the like.

How these and further features of the present invention are accomplished will be described in the following Detailed Description Of The Preferred And Alternate Embodiments, taken in conjunction with the FIGURES. Generally, however, they are provided by using vanes of either the foam filled or vane shell variety, together with operating components that allow them to be mounted in horizontal or vertical orientations. In one embodiment, the vanes are mounted to a sheer fabric, and stacking cord mechanisms as well as tilting mechanisms are provided. In another embodiment, a cordless spring drive motor system is employed for raising and lowering a horizontal door or window covering. In another embodiment of the invention, tapes are used to tilt and lower horizontal door and window coverings made using the vanes of the present invention. In a still further embodiment of the invention, tapes can be used for tilting and lowering of the vanes while the opposite edges of the vanes are attached to a sheer fabric which allows a view between the vanes when they are in the opened position. In a still further embodiment of the invention, the vanes are mounted between tapes, without using a bottom rail. In the preferred embodiments, the foam core vanes or the rigid, hollow vanes described in the aforementioned applications filed on even date herewith are used as the vane elements in the various window covering embodiments. Other ways in which the features of the invention are accomplished will become apparent to those skilled in the art after they have read the foregoing description of the preferred and alternate embodiments, such other ways falling within the scope of the invention if they fall within the scope of the appended claims.

DESCRIPTION OF THE DRAWINGS

In the various FIGURES, like reference numerals are used to depict like components.

Figure 1:
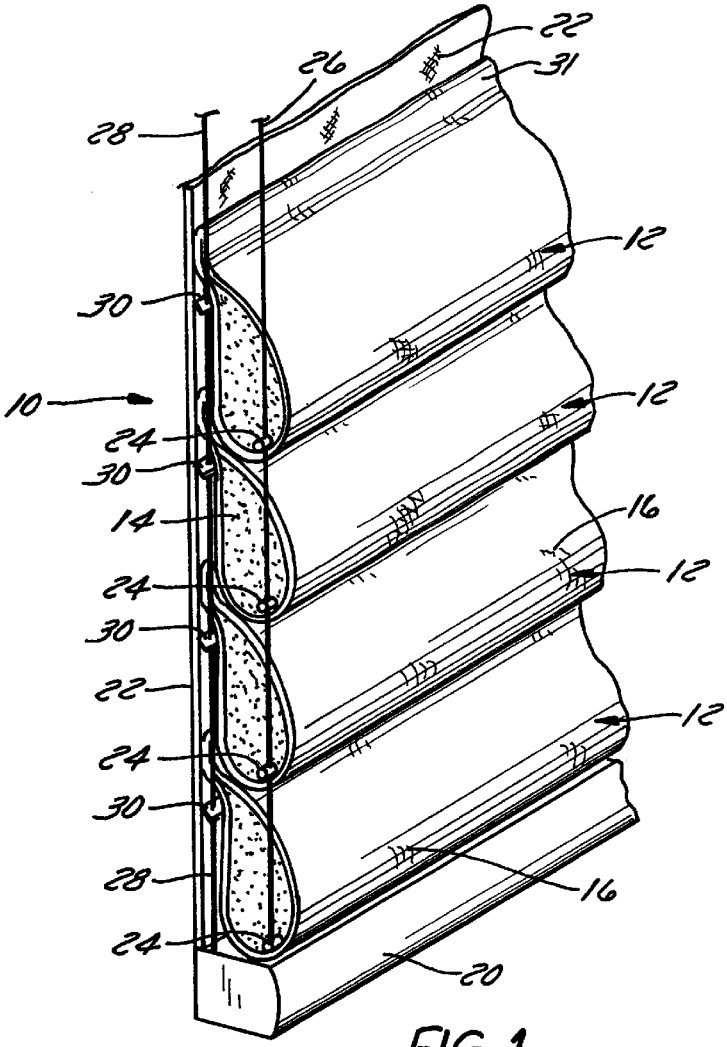
FIG. 1 is a perspective view of a portion of a horizontal window covering using foam core vanes and a sheer fabric.

DETAILED DESCRIPTION OF THE PREFERRED AND ALTERNATE EMBODIMENTS OF THE PRESENT INVENTION

Before beginning the description of the preferred embodiment of the present invention and several alternate embodiments thereof, several general comments should be made about the applicability and the scope of the present invention.

First, while the majority of the illustrated embodiments show the vanes in a horizontal orientation, the vanes can be used in conjunction with a number of vertical window covering designs known in the art, including, but not limited to, those described in the aforementioned Colson, et al. patents and applications.

Second, while the hollow vane embodiment is illustrated in connection with the preferred embodiment of the patent application describing it filed on even date herewith, the hollow interior of the vane can be filled with foam or a foam insert in situations where additional insulation value is desired or required.

Third, the cross-sectional shapes of the vanes, whether foam core or hollow can vary widely without departing from the intended scope of the invention. The air foil shape of the illustrated embodiment is therefor for purposes of illustration, rather than limitation. The vanes could have an oval, cross-sectional configuration, a configuration in which the vanes come to sharper points at both the forward and rearward edges, vanes in which the cross-sectional shape is square, triangular or rectangular vanes and in connection with the latter, rectangles in which the vanes are quite thin so that they resemble the type of vanes used with present day vertical blinds, or in other cross-sectional shapes, such as S-shapes or curled shapes.

Fourth, the hardware used with the vanes of the present invention will not be described in great detail because, in and of itself, the hardware does not form part of the present invention. Accordingly, such devices as the head rail, tracks, trucks, wands, tilt systems and systems for raising and lowering or opening and closing horizontal or vertical blinds may be selected from any of those previously known or subsequently developed as alternatives for present day products. Specifically, however, when cordless systems are referred to herein, they are generally of the type described in U.S. Pat. No. 5,531,257 issued Jul. 2, 1996 and U.S. Pat. No. 5,482,100 issued on Jan. 9, 1996 to Kuhar and assigned to the assignee of the present invention (as well as continuations and divisions thereof). These cordless systems eliminate lift cords typically used in older systems by the operator, enhance product safety and limit the potential for injury to children or pets caused by pull cords.

Fifth, in connection with the hollow vane systems, the vanes of the present invention may include the thermally treated batt material itself, which material may have pleasing aesthetic properties, or the batt material may be painted, printed or otherwise decorated for use as a finished vane. In most applications, however, the thermally formed vane will have an exterior coating of a fabric, which itself may be selected from woven and non-woven fabric materials already known in the blind and door and window covering art, including polyesters, polyolefins, rayons, etc. The covering may be a natural fabric made from cotton, linen, silk, wool or synthetic fabric materials or mixtures thereof. The fabric need not have any particular thickness or dimensional stability properties because the fabric will typically be adhered to the vane prepared from the batt by an adhesive or other bonding technique. It is also within the scope of the present invention to use composite fabric starting materials, so that different sides of the finished vane will have different properties, such as color, light reflectancy, color-fastness and the like. For example, composite fabric strips are known in the window covering art and are described, for example, in European Published Application No. EP 0 692 602 A1 (published 17.01.1996 Bulletin 1996/03) owned to the assignee of the present invention and describing the preparation of starting materials for cellular and light control products. This particular starting material is made by welding, such as by sonic welding, adjacent edges of fabric strips of two different types together. In that published application, the selection of the fabric is generally made based on cost, so that lower cost, non-woven materials can be used for the exterior of the door or window covering, and more expensive designer materials can be used for the portion of the product facing to the inside. Depending upon the final use of the vanes of the present invention, the same considerations that govern the choice of materials in that published application could also be used for selection of starting of materials for vanes manufactured hereunder.

Sixth, in either of the configurations noted in the previous paragraph, i.e. with or without a fabric covering, the vanes of the present invention may be treated with various additives such as flame retardants, water repellants, optical brightners and other treatments known in the fabric care art. Moreover, while the preferred batt material to be used in the present invention is comprised of two polymeric fibers intermeshed with one another and having different melting points, more than the two types of fibers may be employed, including fibers which are not thermoplastic and which may be added for strength or aesthetic reasons, all without departing from the intended scope of the invention. Moreover, the rigid, hollow vanes of the present invention could be filled with foam material utilized in the manner taught in U.S. application Ser. No. 09/371,226 filed Aug. 10, 1999 in the name of Bryan K. Ruggles and entitled "Foam Core Vane For Door And Window Covering". The foam materials which could be used with the rigid, hollow vanes of the present invention include polyurethane and isocyanurate foams or other foams which can be formed in situ or can be inserted manually into the vanes.

Seventh, polyurethane and isocyanurate foams are particularly preferred for use in the present invention because they are readily available and have been used for many years in furniture applications, such as cushions for seating and for insulation purposes for residential and commercial facilities. Other foams could also be used provided they have reaction times to allow them to fully inflate the fabric into the mold openings during the period the covering is captured within the mold cavities. Obviously, the time costs for manufacturing vane products will be lowest when the highest reactivity of the foam components is utilized. Furthermore, the foams may include well-known components for reducing flammability and/or smoke generation of the foams. The physical property of the foam itself can also be readily varied by those familiar with the foam art, so that the vanes could have a spongy feel when grasped or so that a more rigid foam is produced. Techniques for modifying the durometer, reaction speeds and physical properties of such foams are widely known and described in various texts dealing with foam chemistry and in product brochures of major manufacturers of the foam starting materials including polyols, isocyanates, catalysts and the like.

Eighth, the term "longitudinally rigid" is used in this application to indicate that the vane is sufficiently rigid that it can be used in the illustrated and other known horizontal applications without sagging between points of support to the extent that an attractive appearance is destroyed. As with known vinyl, aluminum and wood slats used in horizontal blind systems, some bending is permitted, but not so much that a noticeable sag results between either adjacent lift cord or ribbon attachment points or between the ends of the vane and the nearest of such lift cord or ribbon attachments.

Proceeding now to a description of FIG. 1, a partial, lower perspective view of a horizontal window covering 10 is shown to include four vanes 12, the length and number of which can vary depending upon the dimensions of the door or window covering with which system 10 is to be used. In this illustration, the vanes 12 each include a foam core 14 and a fabric covering 16, such foam core vanes being prepared in accordance with the teachings referred to above. The window covering system 10 also includes a bottom rail 20, a top rail (not shown) and conventional hardware systems for raising and lowering the bottom rail with respect to the top rail.

In FIG. 1, a fabric backing 22 is provided. The technique of attaching vanes 12 to fabric backing 22 will become more apparent from the description of FIG. 2 below. In addition, a cord coupler 24 is provided near the front or blunt edge of each end of each vane 12, and a cord 26 is attached to each of couplers 24 so that if cord 26 is urged upwardly (with respect to the configuration shown in the FIGURE) the forward edges of the vanes 12 will be moved so that the vanes approach a more nearly parallel orientation with respect to each other, allowing a view to be obtained through the fabric backing 22. Additionally a stacking cord 28 is coupled to the bottom rail 20and guide devices 30 are attached to each vane to permit the vanes 12 to be stacked near the top of the window covering 10. In the embodiment shown in FIGS. 1 and 2, cord 26 is positively attached to each vane 12 (through couplers 24) to cause an equal amount of tilting as the cord 26 is moved upwardly or downwardly, while cord 28 passes through the vanes and is only attached to the bottom rail 20. Alternately, cord 28 could be attached to the bottom rail and to each of the vanes 12 to effect raising and lowering of the vanes to a stacked, unstacked or any intermediate position. Cord 28 functions much in the manner of lift cords in conventional mini-blind systems.

Figure 2:
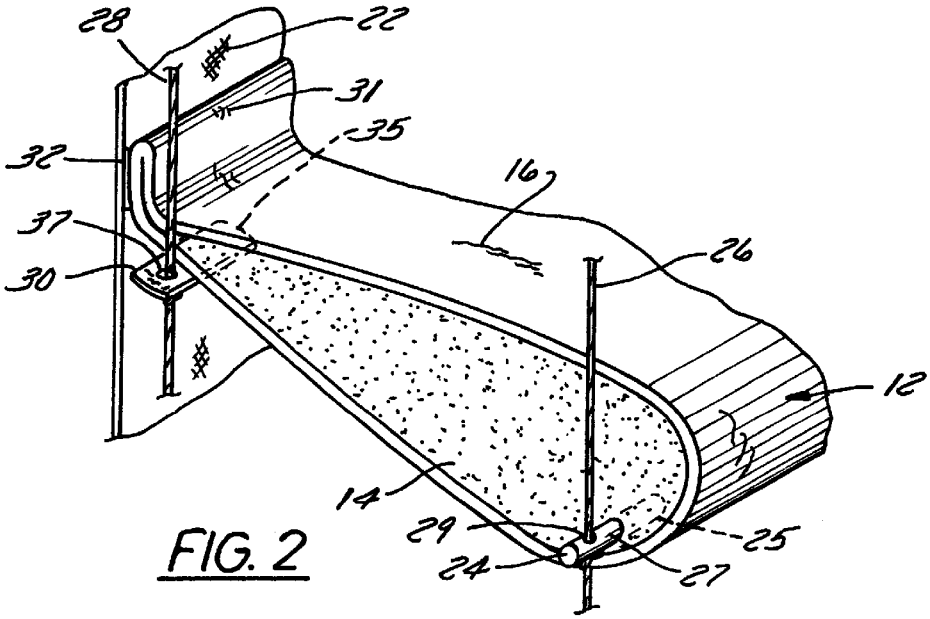
FIG. 2 is an exploded view of a single vane used in FIG. 1 showing the method of its attachment to the sheer fabric and the stacking and vane lifting components in greater detail.

Referring next to FIG. 2, several of the components just described can be better appreciated. First, with regard to the attachment of vanes 12 to fabric backing 22, this illustration indicates that the thin or rearward edge 31 of vanes 12 is adhered to the fabric backing 22 using an adhesive 32. Other techniques, of course, could be used for making the attachment, depending upon the types of materials used for the vane 12 and the type of material used for the fabric backing 22. If thermoplastic materials are used, for example, ultrasonic welding could be employed, as could sewing and other techniques. The tilt cord coupler 24 is also shown, partially in phantom, to include a body member 25 which is embedded into the foam 14 and which may be held therein frictionally or by the use of a suitable adhesive or a mechanical holding device e.g. a barb or hook, etc. The outer end 27 of cord coupler 24 includes an aperture 29 passing therethrough. The tilt cord 26 is knotted below the aperture 29 thereby ensuring that when the cord 26 is raised and lowered, the vanes 12 will be moved simultaneously and in the same amount.

With respect to FIGS. 1 and 2, another set of lifts and tilt cords would normally be located at the opposite ends of the vanes 12. If the distance between the ends of the vanes 12 is substantial, another feature of the present invention is to use a rod (not shown) extending along the entire front edge of the vanes 12 to provide additional rigidity, the rod being apertured at each end to also provide the function of the exterior portion 27 of the coupler 24, i.e. an aperture 29. With proper control of the foam ingredients, sufficient rigidity is preferably obtained without the need for such a rod.

FIG. 2 also shows a tab 35 adhered, sewn or otherwise attached to vane 12 near rearward edge 31. The tab 35 extends beyond the end of vane 12 and includes an aperture 27 through which the stacking cord may pass. As indicated above, it is not necessary that the stacking cord be knotted, but it may be knotted if desired.

The embodiment shown in FIGS. 1 and 2 provides the capability for light blocking, light control, sheer privacy and a high degree of insulation in a vane system which is soft to the touch, making it particularly useful as a high fashion window or door covering. Moreover, as indicated in later FIGURES, the lightweight nature of the foam core vanes 12 allows cordless stacking and a tilt wand technique for causing tilting of the individual vanes. Moreover, unlike some Roman shade products which involve the use of loose and floppy material, the present invention provides vanes which are uniform in appearance and have a drape characteristic which is superior to that which is achievable using looped fabric.

Figure 3:
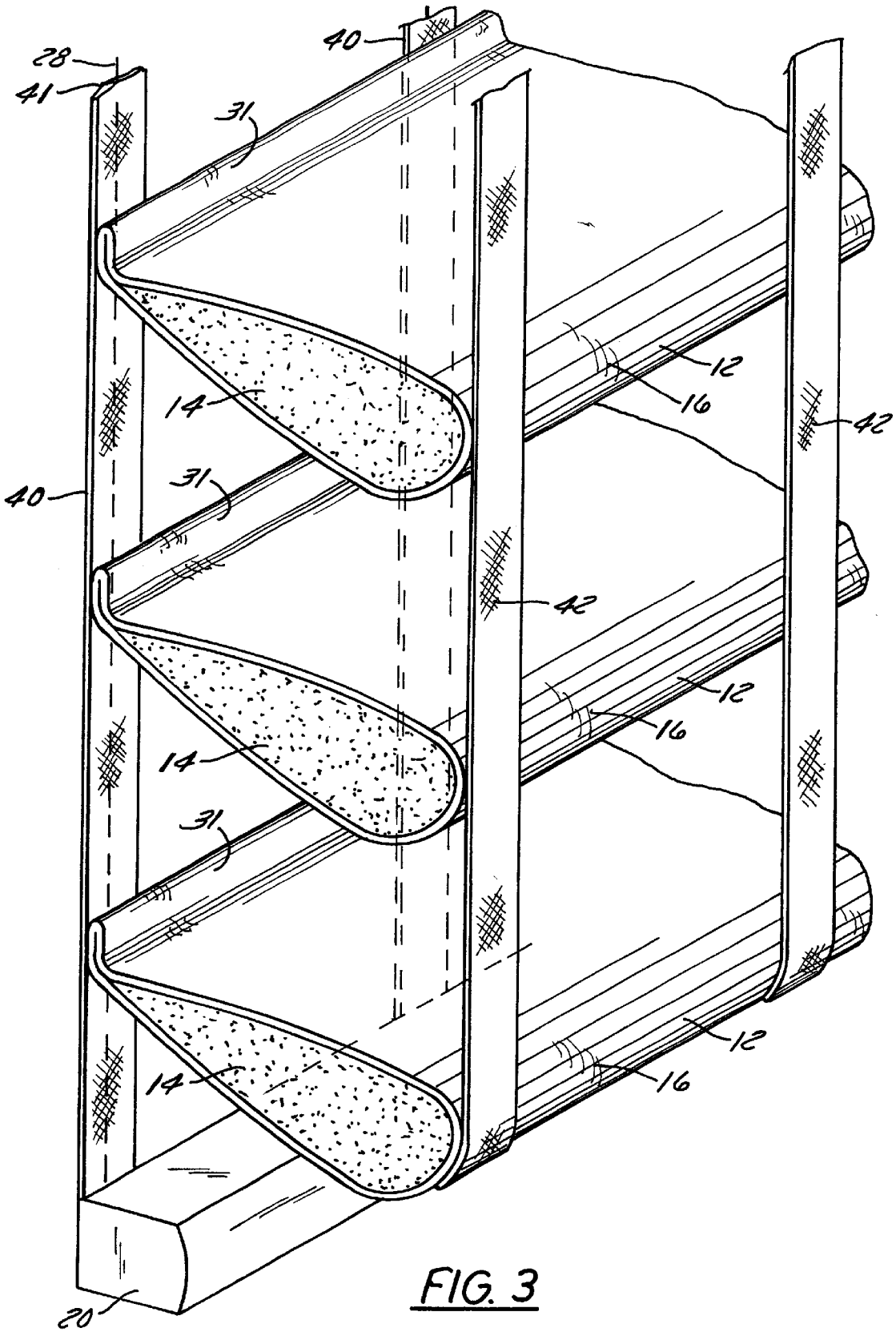
FIG. 3 is a perspective view of an alternate embodiment using foam core vanes in a horizontal orientation with support and vane pivoting ribbons.

FIG. 3 shows an alternate embodiment, i.e. another window covering made in accordance with the present invention, this time showing the foam core vanes 12 in a parallel or open orientation. FIG. 3 differs from the embodiment shown in FIGS. 1–2 in that the fabric backing 22 is eliminated and ribbons 40 and 42 are used for stacking and tilting respectively.

Dealing first with ribbons 40, a first end is attached to the bottom rail 20 and the second end (not shown) is connected to a head rail assembly. Lift cords 28 pass through openings 41 in ribbons 40 along the length of the ribbon 40 and are also coupled to bottom rail 20. The vanes 12 are attached to the ribbons at trailing edge 31 using the techniques described above for the attachment of the vanes to a fabric backing.

At the leading or forward edge of vanes 12, ribbons 42 are attached, and no cord couplers are employed. The technique for attaching the fabric covering of the vanes 12 to ribbons 42 may also be selected from the techniques described above, i.e. use of an adhesive, ultrasonic welding, stitching and the like. Manipulation of ribbons 42 in an upward or downward direction will increase and decrease the amount of open area between the vanes, permitting the full range of options for the user between an open view and complete privacy, and the vanes 12 themselves may be eliminated from the door or window opening by raising the bottom rail 20, causing the vanes 12 to stack at the top. In this embodiment, the ribbons are preferably made from sheer materials to reduce overall weight, and to facilitate a feeling of openness.

Figure 4:
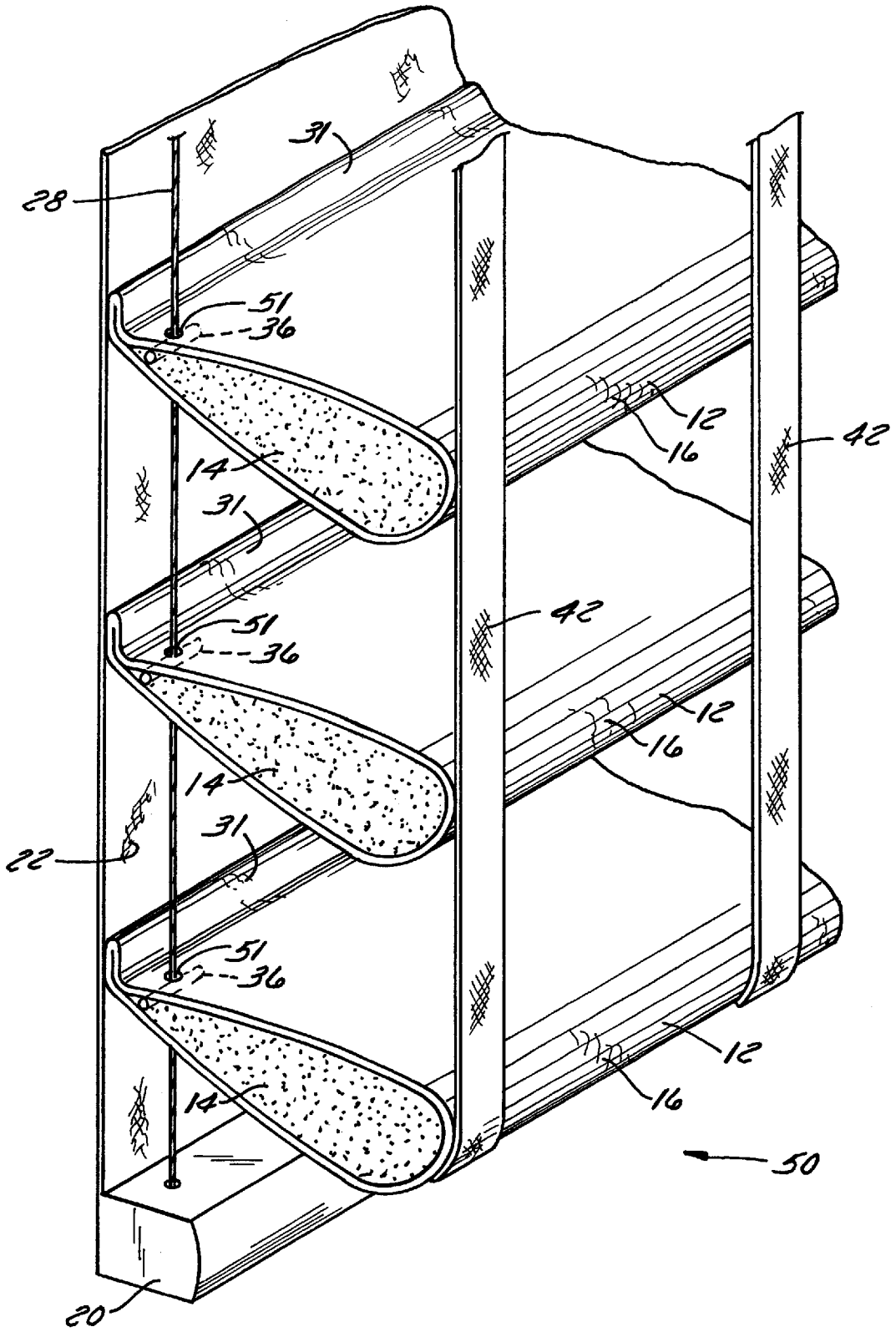
FIG. 4 is a perspective view of another covering for doors or windows wherein foam core vanes arranged in a horizontal orientation are used with vane lifting ribbons and a sheer fabric backing.

A hybrid window covering 50 is shown in FIG. 4, i.e. one which includes a fabric backing 22 on the rear side and ribbons 42 on the front. It can also be noted in this drawing that the lift cord 28 passes through the vanes 20 and that tabs 35 do not extend beyond the edges of vanes 12. An opening 51 is provided in a connector 36 located adjacent edge 31 of vane 12. The cord coupler system 24 described in connection with FIG. 1 is also eliminated in favor of the tilt ribbons 42, thereby providing a window covering in which no component extends beyond either end of vanes 12. The various techniques for attaching the ribbons 42 to the vanes 12 and the vane edges 31 to the fabric backing 22 are described above and are useful in this embodiment.

Figure 5:
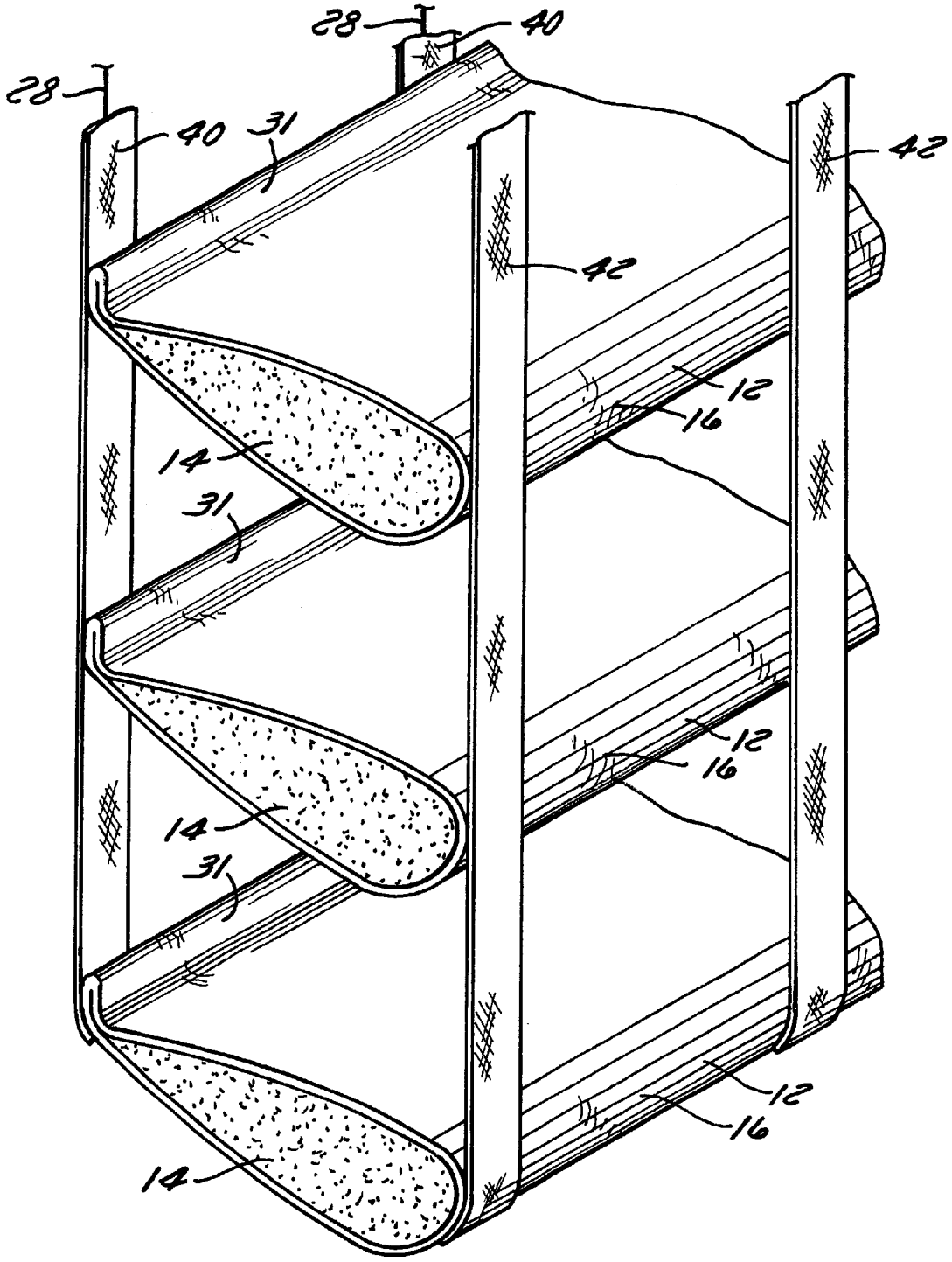
FIG. 5 is a perspective view of the lower portion of another horizontal vane door and window covering, showing lifting and tilting ribbons and showing the lowermost vane serving the function of a conventional bottom rail.

FIG. 5 illustrates yet another embodiment of the invention wherein fabric covered vanes 12 are attached at both the forward and rearward edges to ribbons 40 and 42. However, in this embodiment, the bottom rail 20 has been eliminated so that, in effect, the lowermost vane 12 serves as the bottom rail. This particular embodiment provides a Roman shade like fashion which is insulative and which provides light control. Cordless operation is possible, as has been previously suggested in connection with other embodiments and an entirely clear view is provided when vanes 12 are in a horizontal position. The window or door covering is soft to the touch, with the vanes having an attractive, uniform appearance. Moreover, as previously mentioned, water or stain repellants can be added to the fabric covering 16 of vanes 12.

Figure 6:
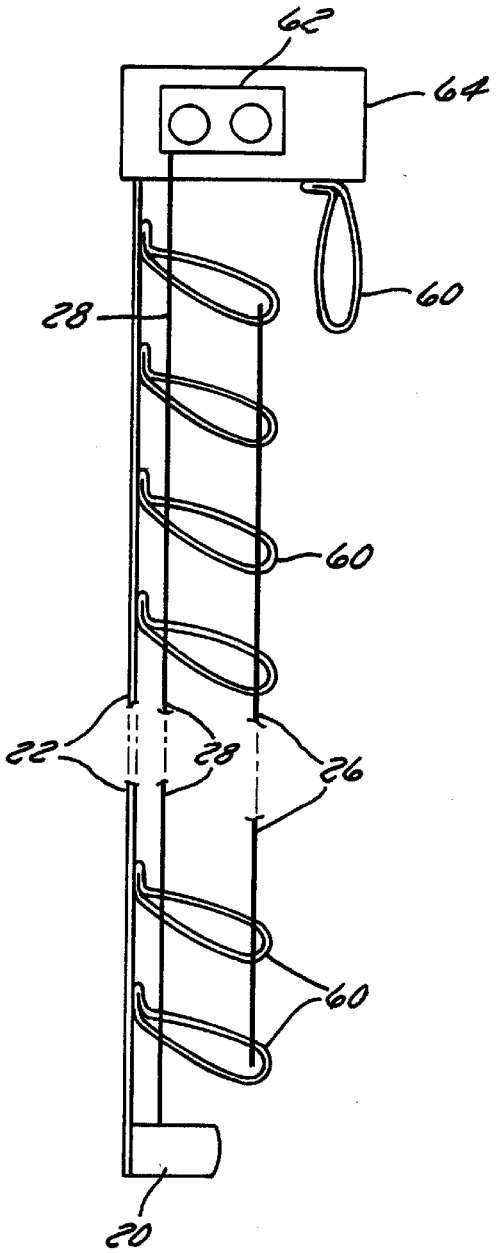
FIG. 6 is an end view of a hollow core, rigid vane system, the vanes being arranged in a horizontal orientation, this FIGURE also illustrating the use of an optional spring motor for cordless operation of the window covering.
Figure 6A:
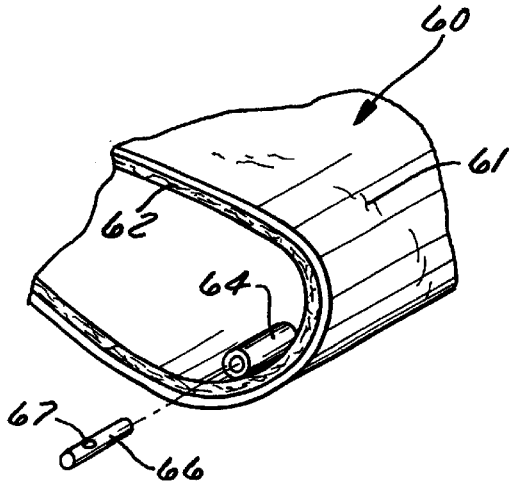
FIG. 6A is a perspective partial end view of one of the vanes shown in FIG. 6 and illustrating the vane lift cord locking mechanism used therewith, the locking mechanism itself being shown in an exploded view.

Proceeding now to a still further embodiment of the invention shown in FIG. 6, hollow core vanes 60 are employed, as are described in the aforementioned application Ser. No. 09/594,619, which application is incorporated herein in its entirety by this reference. The lift cord 28 in this illustration is schematically shown as being coupled to a spring motor 62 located within head rail 64. The operation of such spring motors is described in the aforementioned Kuhar patents and also needs not be described in detail herein. FIG. 6 also shows another modification in which a single one of the vanes 60 is suspended from its tail or rearward edge from the head rail 64 to act like a valance. Otherwise, the window covering operates in the manner as described above in connection with FIG. 1. FIG. 6A shows one attachment technique which may be used for the guide cord elements used for tilting vanes 60. These are shown as two component plugs, a female portion 64 which is adhered or otherwise suitably attached to the hollow core vane 60. In this illustration, the fabric covering of the vane is illustrated as reference numeral 61 while the backing, preferably consisting of fibers at least partially enveloped by a polymer matrix is shown as 62. A male portion 66 is shown to be insertable into female portion 64, male portion 66 having an opening 67 on its outer end, through which the tilt cord 26 may be passed and attached as was discussed in connection with FIG. 1. The attachment technique shown in FIG. 2 could also be employed without departing from the scope of the invention as it pertains to this embodiment.

Figure 7:
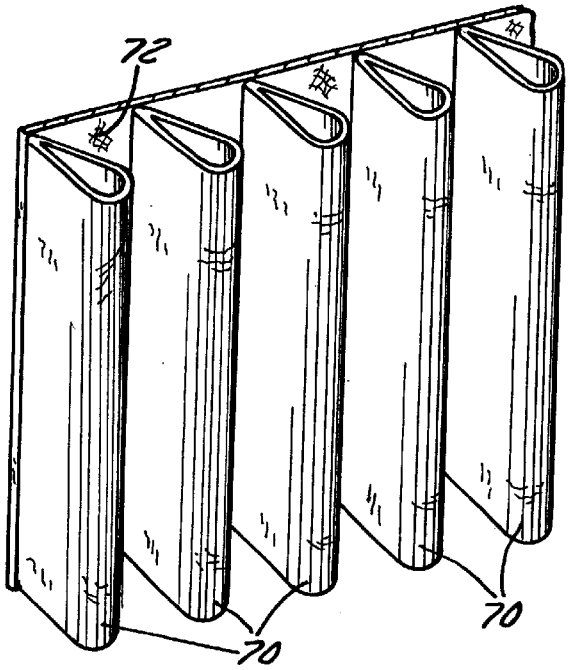
FIG. 7 is a perspective view of a vertical window covering in which a sheer fabric is coupled to the forward edge of rigid, three dimensional vanes according to the present invention.
Figure 7A:
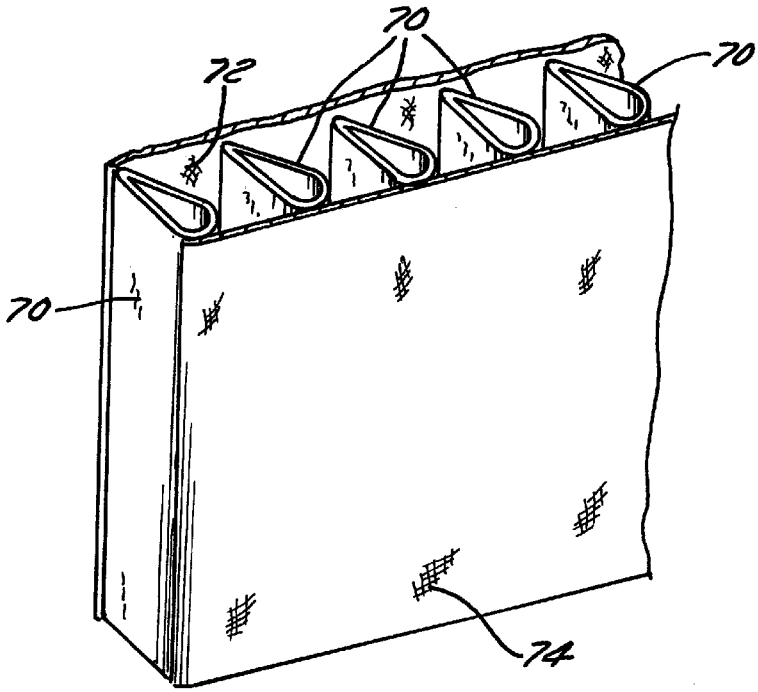
FIG. 7A is another perspective view of a vertical window covering in which sheer fabrics are applied to both the forward and rear edges of the vanes, to provide a decorative and functional vertical window or door covering.

Finally, FIGS. 7 and 7A illustrate two embodiments where lightweight, rigid air-foil shaped vanes 70 are shown attached to sheer fabrics 72 (in the case of FIG. 7) and 72 and 74 (in the case of FIG. 7A), and wherein the vanes are arranged vertically. The various techniques used for attaching the vanes to the sheer fabric 72 and 74 which have been described above in connection with other embodiments are equally applicable here. Moreover, the technique for mounting the vanes to the trucks in a vertical blind system is well-known and, in and of itself, does not form part of the present invention. For example, a panel may be sewn or otherwise adhered around the upper portion of each vane to which a clip or other attachment device can be affixed. The clip or other device, in turn, is coupled to the trucks in manners which may be variously embodied as will be appreciated by those skilled in the art after they have read this specification.

In both FIGS. 7 and 7A, soft, light control and insulative door and window coverings are provided which have significant advantages over those made from flexible materials, particularly with regard to the twist which occurs when the upper portion of a vane is rotated to allow the vane to move from an open to a closed position. With the foam core or hollow rigid vanes according to the present invention, such twist occurs uniformly from the top to the bottom of the vane and presents an overall desirable aesthetic appeal for the end user.

Figure 8:
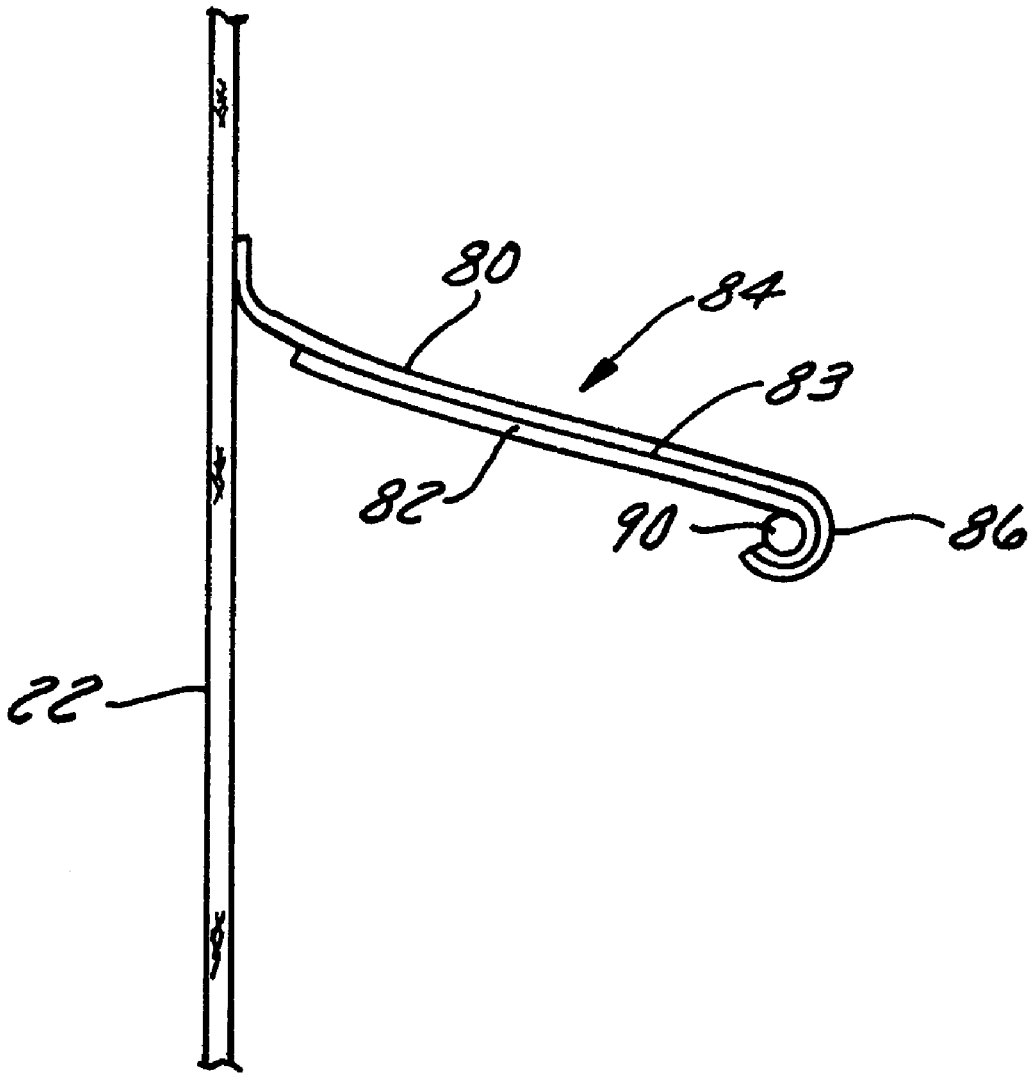
FIG. 8 is a partial end view of another alternate embodiment using a curled slat.

FIG. 8 shows yet another embodiment using a curled slat of the type discussed in connection with FIG. 6 of the aforementioned "Window Covering Slat" application. In this embodiment, the fabric covering 80 for the slat base 82 (e.g. a polymer matrix at least partially enveloping high-melt fibers) of slat 84 is welded or adhesively attached to the sheer 22. A thin adhesive layer 83 bonds fabric 80 to the shat base 84. The outer edge 86 is curled and serves as an optimal location for a support rod 90 for long span slats. The ribbon or plug cord adapters shown in the other FIGURES can be used instead. This embodiment yields an attractive window covering with a reduced slat stack thickness.

While the present invention has been described in connection with several preferred and alternate embodiments, the invention is not to be limited thereby but is to be limited solely by the scope of the claims which follow.

What is claimed is:

1. A door or window covering comprising a plurality of elongate, longitudinally rigid vanes arranged to be rotated between open and closed positions, the vanes being selected from the group consisting of fabric covered foam core vanes or hollow vanes having a vane shell defining a hollow interior and the vane shell including a polymer matrix at least partially enveloping fibers, the door or window covering further including at least one sheer fabric attached to an edge of each vane.

2. The door or window covering of claim 1 wherein the vanes are arranged horizontally.

3. The door or window covering of claim 1 wherein the vanes are arranged vertically.

4. The door or window covering of claim 1 wherein a sheer fabric is attached to two opposed edges of the vanes.

5. The door or window covering of claim 2 wherein a coupler is provided at each end of each vane and a tilt cord is operatively connected to each coupler to rotate the vanes between the open and closed positions.

6. The door or window covering of claim 2 wherein the vanes are air foil in shape and a sheer fabric is flexibly coupled to the thin edge of each vane.

7. The door or window covering of claim 2 further including a headrail and a bottom rail and at least two lift cords are operatively coupled to the vanes and the bottom rail.

8. The door or window covering of claim 7 wherein the lift cords are also coupled to at least one spring motor and the door or window covering is balanced to provide cordless positioning of the bottom rail at any location between a fully lowered and a fully raised position.

9. The door or window covering of claim 5 wherein each coupler includes an aperture for receiving a tilt cord and a fastener for attaching the coupler to the vane end.

10. The door or window covering of claim 2 wherein a rod extends along the length of the vane to provide additional rigidity thereto.

11. The door or window covering of claim 2 wherein the vanes are rotated by at least one pair of ribbons attached to a vane edge.

12. The door or window covering of claim 1 wherein the vanes are hollow vanes and include a fabric covering on the exterior of the vane shells.

13. The door or window covering of claim 5 wherein the vanees are foam core vanes and wherein each coupler is at least partially embedded in the foam.

14. The door or window covering of claim 3 wherein a sheer fabric is attached to two opposed edges of the vanes.

15. The door or window covering of claim 3 wherein a coupler is provided at one end of the vane for being coupled to a vertical blind hardware system.

16. The door or window covering of claim 3 wherein the vanes are air foil in shape and a sheer fabric is flexibly coupled to the thin edge of each vane.

17. A door or window covering comprising a plurality of elongate, longitudinally rigid vanes having a vane shell defining a hollow interior and disposed horizontally and in a parallel and spaced apart orientation, each vane having a front edge and a rear edge, means coupling the front edges of the vanes for rotating the vanes upwardly or downwardly about an axis lying near the rear edges of the vanes, means coupling the rear edges of the vanes for raising and lowering the plurality of vanes and for decreasing the spacing between the rear edges of adjacent vanes and further including at least one sheer fabric attached to an edge of each vane.

18. The door or window covering of claim 17 wherein each vane includes a foam core.

19. The door or window covering of claim 17 wherein each of the rotating and raising, lowering and decreasing means is selected from the group consisting of ribbons and cords.

20. The door or window covering of claim 17 wherein each vane shell includes a polymer matrix at least partially enveloping fibers.

21. The door or window covering of claim 20 wherein each vane includes a fabric covering on the exterior of the vane shell.

* * * * *